US012129526B2

(12) United States Patent
Zhang et al.

(10) Patent No.: US 12,129,526 B2
(45) Date of Patent: Oct. 29, 2024

(54) GRADIENT STEEL MATERIAL HAVING SURFACE LAYER WITH FERRITE AND INNER LAYER WITH FERRITE + PEARLITE AND MANUFACTURING METHOD

(71) Applicant: BAOSHAN IRON & STEEL CO., LTD., Shanghai (CN)

(72) Inventors: Suoquan Zhang, Shanghai (CN); Sihai Jiao, Shanghai (CN); Jianhua Ding, Shanghai (CN); Xiaojun Liang, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 685 days.

(21) Appl. No.: 17/413,781

(22) PCT Filed: Dec. 27, 2019

(86) PCT No.: PCT/CN2019/129096
§ 371 (c)(1),
(2) Date: Jun. 14, 2021

(87) PCT Pub. No.: WO2020/135691
PCT Pub. Date: Jul. 2, 2020

(65) Prior Publication Data

US 2022/0010393 A1 Jan. 13, 2022

(30) Foreign Application Priority Data

Dec. 28, 2018 (CN) ..... 201811622955.5

(51) Int. Cl.
*C21D 8/02* (2006.01)
*C22C 38/02* (2006.01)
*C22C 38/04* (2006.01)

(52) U.S. Cl.
CPC ..... *C21D 8/0247* (2013.01); *C21D 8/0205* (2013.01); *C22C 38/02* (2013.01);
(Continued)

(58) Field of Classification Search
None
See application file for complete search history.

(56) References Cited

FOREIGN PATENT DOCUMENTS

CN 105829561 A 8/2016
CN 105908086 A 8/2016
(Continued)

OTHER PUBLICATIONS

International Search Report dated Mar. 23, 2020 for corresponding PCT patent application No. PCT/CN2019/129096.
(Continued)

*Primary Examiner* — Anthony M Liang
(74) *Attorney, Agent, or Firm* — Amster, Rothstein & Ebenstein LLP

(57) ABSTRACT

Provided are a gradient steel material having a surface layer with ferrite and an inner layer with ferrite+pearlite, and a manufacturing method, the weight percentages of the components are: C≤0.15%, Si≤1%, Mn≤1.5%, the balance of Fe and inevitable impurities, and the surface layer of the steel material is ferrite, the inner layer is ferrite+pearlite. The manufacturing method thereof includes: smelting, casting, rolling, heat treatment; wherein, in the heat treatment step, the steel material is heated above the austenitizing temperature Ac3, and hold at the temperature more than 3 min to ensure that the material is completely austenitized; subsequently, it is cooled to a temperature below Ar1 at a cooling rate lower than 0.5° C./s. The present steel material does not need to be obtained by means of the compound preparation
(Continued)

of different materials, and is only processed and prepared by a single material, the process is short, the procedure is simple, and the cost is low.

2 Claims, 2 Drawing Sheets

(52) U.S. Cl.
CPC ..... *C22C 38/04* (2013.01); *C21D 2211/005* (2013.01); *C21D 2211/009* (2013.01)

(56) References Cited

FOREIGN PATENT DOCUMENTS

| | | | |
|---|---|---|---|
| CN | 108085591 | A | 5/2018 |
| CN | 108138294 | A | 6/2018 |
| CN | 110073018 | A | 7/2019 |
| EP | 3088544 | A1 | 11/2016 |
| JP | 2014-025131 | A | 2/2014 |
| JP | 2018-123367 | A | 8/2018 |
| JP | 2000-096181 | A | 4/2020 |
| WO | 2015097882 | A1 | 3/2017 |
| WO | 2017099433 | A1 | 6/2017 |
| WO | 2018110152 | A1 | 6/2018 |

OTHER PUBLICATIONS

Japanese Office Action as Issued on Jul. 19, 2022 in Respect to Counterpart Japanese Patent Application No. 2021-534737 and its English Translation.
Supplementary European Search Report dated Oct. 22, 2021 from PCT International Patent Application No. PCT/CN2019/129096.

GRADIENT STEEL MATERIAL HAVING SURFACE LAYER WITH FERRITE AND INNER LAYER WITH FERRITE + PEARLITE AND MANUFACTURING METHOD

CROSS REFERENCE TO RELATED APPLICATIONS

This application is a national phase of PCT application No. PCT/CN2019/129096, filed Dec. 27, 2019, which claims priority to CN patent application No. 201811622955.5, filed Dec. 28, 2018, all of which are incorporated herein by reference thereto.

TECHNICAL FIELD

The present invention relates to a gradient steel material, in particular to a gradient steel material having a surface layer with ferrite and an inner layer with ferrite+pearlite, and a manufacturing method.

BACKGROUND

The strength and plasticity of steel materials are often two contradictory property indicators. It is often difficult to obtain satisfactory plasticity while pursuing strength. For some materials used for twisting or bending, the maximum deformation occurs on the surface layers of the materials. During the twisting or bending, the strain becomes smaller and smaller from the surface to the core, and the plasticity requirement is getting lower and lower. Therefore, if a material having a surface layer with high plasticity but slightly low strength and an inner layer with slightly low plasticity but high strength can be developed, it will be very helpful to solve the problem. While the surface material meets the large deformation of the surface layer, the inner material provides high strength. In this context, it is of great significance to develop a gradient steel material with different surface layer microstructure and inner layer microstructure.

The existing solutions are mainly to achieve the compounding of different materials through methods such as rolling cladding, explosive compounding and bonding compounding. There are many patents in this area, more than 1000. For example, the rolled clad plate produced by Baosteel as a leader is a clad plate product, with both properties such as corrosion resistance and other properties of the stainless steel, nickel-based alloys and titanium alloys of the surface layer and high strength of matrix materials, which is obtained by compounding functional materials such as stainless steel, nickel-based alloys and titanium alloys with structural materials such as carbon steel through a method of rolling after assembly, thereby achieving further upgrades in material functions. Chinese patents such as CN201110045798.8, CN201310211969.9, CN201410707715.0, CN201310212003.7, CN201310213371.3, CN201510173144.1, CN201611223874.9, CN201510621011.6 and CN201510173145.6 all introduce such rolling cladding technologies. In addition, explosive compounding has also been used in some applications. According to this technology, explosives are evenly distributed on surface metal and detonated to compound the surface metal and the base metal. Chinese patents CN201520878950.4, CN201510738639.4, CN201620972383.3 etc. introduce this type of related technologies. There are also many patents where metals or non-metals are bonded together through bonding methods to obtain clad plates meeting functional requirements, such as Chinese patents CN201720527381.8, CN201810506236.0 and CN201711015280.3. Combining the methods disclosed in the above documents, currently two or more pieces of different materials are combined together mainly through different metallurgical or mechanical compound methods to have different microstructures and special functions.

In order to develop novel heat-resistant materials that can withstand large temperature differences, Japanese scholars Masayuki Niino et al. first proposed the concept of a gradient material. The gradient material is a novel composite material, and compared with traditional composite materials, the gradient material has the characteristic of continuous changes of tissue and mechanical properties and the like and has no obvious interface, which can effectively alleviate and eliminate material failure due to thermal stress damage at the interface. Northeastern University conducted unidirectional cooling on steel plates through controlled cooling, which results in a gradient change in the steel microstructure, a microstructure with high strength, high hardness and high wear resistance, such as martensite or bainite, is distributed on the surface; and a microstructure with high toughness and good plasticity, such as a ferrite or pearlite, is distributed inside the material. For the material of which the microstructures are in gradient distribution and the microstructures on two sides have respective property advantages, the side with high strength and high hardness can meet the demand for strength and wear resistance; and the side with high toughness and good plasticity can meet the demand for toughness and machining deformation.

Large deformation technologies can also effectively refine the microstructure and achieve gradient changes in material microstructures or properties. At present, the most widely used large deformation technologies include equal channel angle pressing (ECAP), ultrasonic shot peening (USP), surface mechanical attrition treatment (SMAT), high pressure torsion (HPT), and so on. All the above studies achieve the gradient changes in the mechanical properties and the microstructure on material surfaces by refining the microstructure with the large deformation technologies.

SUMMARY

The present invention aims to provide a gradient steel material having a surface layer with ferrite and an inner layer with ferrite+pearlite, and a manufacturing method, the steel material does not need to be obtained by means of the compound preparation of different materials as only a single material is processed, and at the same time, the components of the steel material is simple; the steel material of the present invention is an continuous material, although the internal microstructure and the external microstructure are different, the difference is a gradual process, and the metallurgical strength at the interface is good; and meanwhile, the whole material has a low carbon content, which ensures good welding property.

In order to achieve the above objective, the technical solution of the present invention is:

a gradient steel material having a surface layer with ferrite and an inner layer with ferrite+pearlite comprises the following components in percentage by weight: $0<C\leq0.15\%$, $0<Si\leq1\%$, $0<Mn\leq1.5\%$, the balance of Fe and inevitable impurities, the surface layer of the steel material is ferrite, and the inner layer is ferrite+pearlite. Wherein, the surface layer thickness varies according to the thickness of the steel plate, and is usually within 1 mm.

Preferably, the surface layer of the gradient steel material is a ferrite, with a low carbon content not higher than 0.02 wt %, where 0.02 wt % is the result of keeping two decimal places, that is, it covers a range of values from 0.015 wt % to 0.024 wt %, preferably, the carbon content of the surface layer is not higher than 0.022 wt %; and the carbon content of the inner layer is relatively high, and is higher than the average carbon content of the whole gradient steel material, that is, the carbon content of the surface layer of the steel material is lower than the carbon content of the inner layer of the steel material.

The manufacturing method of a gradient steel material having a surface layer with ferrite and an inner layer with ferrite+pearlite according to the present invention includes: smelting, casting, rolling and heat treatment; wherein in the heat treatment step, a steel material is heated above the austenitizing temperature Ac3, and hold at the temperature more than 3 min to ensure that the material is completely austenitized; and subsequently, it is cooled to a temperature below Ar1 at a cooling rate of less than 0.5° C./s.

The idea of the method according to the present invention is that during the heat treatment, the whole steel material is heated for completely austenitization, and then slowly cooled, so that the surface layer of the material preferentially obtains the ferrite. Since the solid solubility of carbon in the ferrite is relatively low, the new ferrite releases carbon into the internal austenite, and thus the internal austenite tends to be more stable. As the ferrite further nucleates and grows up, the surface ferrite layer becomes thicker and thicker, the carbon content in the inner austenite becomes higher and higher, and the microstructure becomes more and more stable. In the subsequent further cooling process, the internal austenite transforms into a mixed microstructures of ferrite and pearlite.

Compared with clad plates obtained through rolling cladding, explosive compounding and bonding compounding, only one material is rolled and subjected to heat treatment in the present invention, and there is no need to subject two materials to assembly and other treatments. At the same time, in the final product, the steel material is an continuous material. Although the internal microstructure and the external microstructure are different, the difference is a gradual process, and the metallurgical strength at the interface is good.

In the prior art, a steel plate is subjected to unidirectional cooling through controlled cooling to achieve a gradient change in the microstructure, a microstructure with high strength, high hardness and high wear resistance, such as a martensite or bainite, is distributed on the surface; and a microstructure with high toughness and good plasticity, such as a ferrite or pearlite, is distributed inside the material, since the surface of the material cools quickly and the inner layer cools slowly during the cooling process. However, the present invention desires to obtain a microstructure with high toughness and good plasticity distributed on the surface and a microstructure with high strength, high hardness and high wear resistance distributed inside. Therefore, the present invention is achieved by controlling the cooling rates within a certain temperature range so that the surface layer of the material undergoes phase transformation first while the inner layer does not undergo phase transformation temporarily, and finally a ferrite microstructure with good plasticity on the surface layer and a pearlite and ferrite microstructure with high strength on the inner layer are obtained. When the inner layer is a pearlite+ferrite, the strength is greater than that of the outer layer of pure ferrite, so that the material is conducive to processing methods for large surface deformations such as bending and torsion. Meanwhile, in the present invention, since carbon in the surface layer transfers to the inner layer through ultra-long range diffusion, internal carbon is increased and the strength is increased, but the overall carbon content of the material is not high, and good welding property is maintained.

At the same time, the present invention does not need to refine the microstructure through the large deformation technology, thus the gradient changes in the mechanical properties and the microstructure are achieved on the surface of the material, and the manufacturing method is simple.

The material obtained by the method of the present invention is as shown in FIG. 1: the outer layer microstructure of the material is ferrite, as shown by the part outside the dashed circle in FIG. 1, and the inner layer microstructure is a mixed microstructures of ferrite and pearlite, as shown by the part inside the dashed circle in FIG. 1.

The beneficial effects of the present invention are as follows:

The gradient steel material having the surface layer with ferrite and the inner layer with ferrite+pearlite can obtain a ferrite layer with good plasticity on the surface layer and a mixed microstructures of ferrite and pearlite with high strength in the inner layer, and compared with the prior art, the steel material has the following advantages:

(1) There is no need to compound two materials, and only a single material is processed and prepared.

(2) The method of the present invention is short in process flow, simple in procedure and low in cost.

(3) The steel plate of the present invention is an continuous material, the difference of the microstructure on the two sides is a gradual process, and the metallurgical strength at the interface is good.

(4) In the present invention, since carbon in the surface layer transfers to the inner layer through ultra-long range diffusion, internal carbon is increased and the strength is increased, but the overall carbon content of the material is not high, and good welding property is maintained.

DETAILED DESCRIPTION

The present invention will be further illustrated below in conjunction with embodiments and accompanying drawings.

The components in the examples and the comparative embodiments of the present invention are shown in Table 1, and the balance of Fe and unavoidable impurities. The manufacturing method for a steel material is as follows: the steel material obtained through converter or electric furnace smelting, heating and rolling is then heat-treated to finally obtain a gradient steel material having a surface layer with ferrite and an inner layer with ferrite+pearlite.

TABLE 1

| Unit: weight percentages | | | |
|---|---|---|---|
| | C | Si | Mn |
| Example 1 | 0.054 | 0.26 | 0.51 |
| Example 2 | 0.075 | 0.252 | 0.49 |
| Example 3 | 0.081 | 0.243 | 1.23 |
| Example 4 | 0.105 | 0.356 | 0.56 |
| Example 5 | 0.112 | 0.366 | 0.76 |
| Comparative Example 1 | 0.054 | 0.26 | 0.51 |
| Comparative Example 2 | 0.15 | 1.5 | 0.48 |

TABLE 2

| | Heating temperature | Holding time | Slow cooling speed | Slow cooling final temperature | Surface layer microstructure | Inner layer microstructure |
|---|---|---|---|---|---|---|
| Example 1 | 950° C. | 600 s | 0.05° C./s | 200° C. | ferrite | ferrite + pearlite |
| Example 2 | 950° C. | 600 s | 0.10° C./s | 600° C. | ferrite | ferrite + pearlite |
| Example 3 | 1000° C. | 300 s | 0.05° C./s | 20° C. | ferrite | ferrite + pearlite |
| Example 4 | 1000° C. | 300 s | 0.2° C./s | 200° C. | ferrite | ferrite + pearlite |
| Example 5 | 1000° C. | 300 s | 0.3° C./s | 600° C. | ferrite | ferrite + pearlite |
| Comparative Example 1 | 1000° C. | 300 s | 0.5° C./s | 600° C. | ferrite + pearlite | ferrite + pearlite |
| Comparative Example 2 | 1000° C. | 300 s | 0.05° C./s | 600° C. | ferrite + pearlite | ferrite + pearlite |

The comparative examples of the application intend to illustrate that when the content of C, Si and Mn is not within the range of $0<C\leq0.15\%$, $0<Si\leq1\%$, $0<Mn\leq1.5\%$ as defined in the application, or the cooling rate does not meet the definition of the application, the microstructure of the gradient steel material having the surface layer with ferrite and the inner layer with ferrite+pearlite cannot be obtained.

Table 2 shows the heat treatment process in the examples of the manufacturing method of the present invention and the comparative examples.

Figure 1:
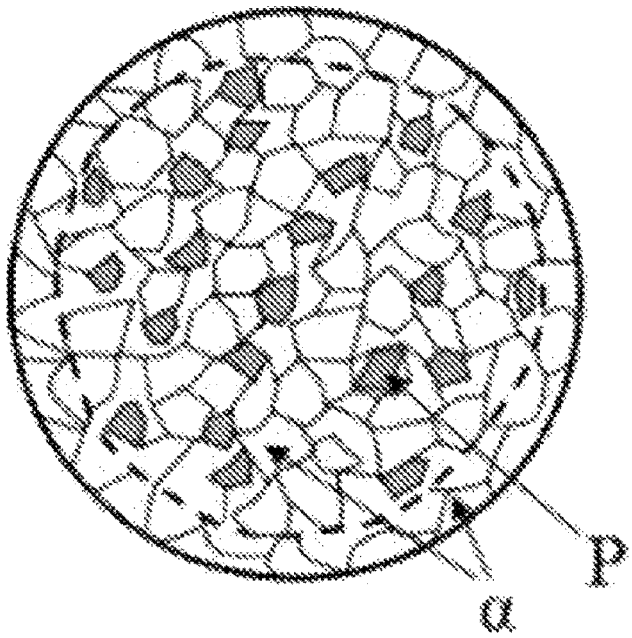
FIG. 1 is a schematic diagram of microstructures of a gradient steel material of the present invention, wherein a represents ferrite, and P represents pearlite.
Figure 2:
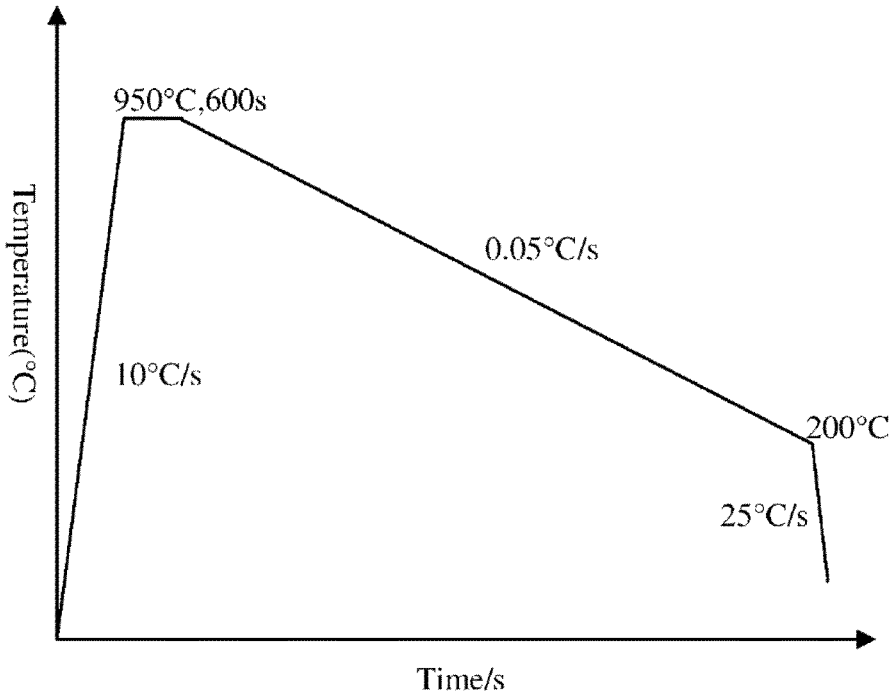
FIG. 2 is a schematic diagram of a heat treatment process in examples of a manufacturing method of the present invention.

FIG. 1 shows the microstructure of the gradient steel material of the present invention, the surface layer is a ferrite, and the inner layer is a mixed microstructures of ferrite and pearlite. FIG. 2 shows a heat treatment process in examples of the manufacturing method of the present invention.

Figure 3:
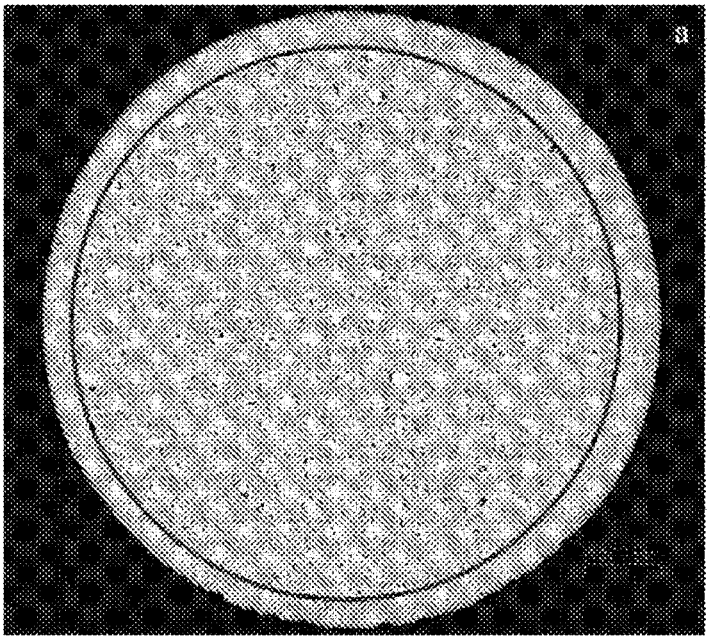
FIG. 3 is a microstructure diagram of a whole cross-section of a sample in Example 1 of the present invention.
Figure 4:
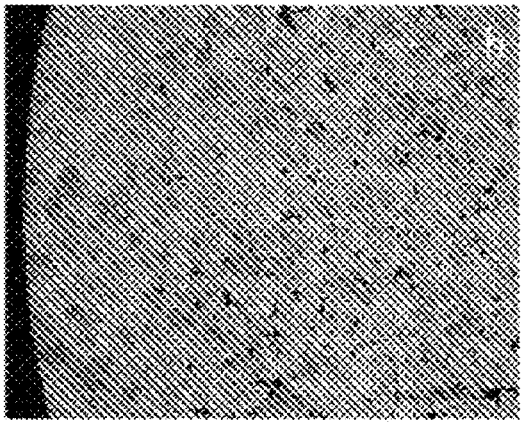
FIG. 4 is a microstructure diagram of a near-surface layer of a sample in Example 1 of the present invention.
Figure 5:
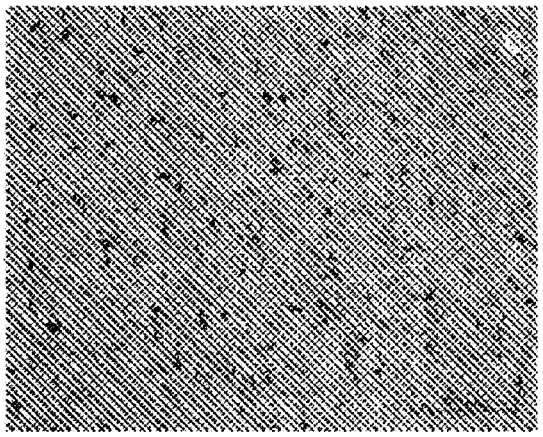
FIG. 5 is an enlarged microstructure diagram of an inner layer of a sample in Example 1 of the present invention.

FIG. 3 shows a final microstructure of Example 1. It can be found from FIG. 3 that the surface layer is a ferrite within a range of about 450 μm, and the inner layer is a mixed microstructures of ferrite and pearlite. FIG. 4 is an enlarged metallograph of the near-surface layer of the sample, and it can be seen that the surface microstructure is a pure ferrite. FIG. 5 is an enlarged metallograph of the inner layer of the sample, and it can be seen that the inner layer microstructure is a mixed microstructures of ferrite and pearlite.

The invention claimed is:

1. A gradient steel material having a surface layer with ferrite and an inner layer with ferrite+pearlite, comprising a plurality of components defined in percentage by weight including: $0<C\leq0.15\%$, $0<Si\leq1\%$, $0<Mn\leq1.5\%$, and a remaining balance of Fe and inevitable impurities, wherein the surface layer of the gradient steel material is ferrite and the inner layer is ferrite+pearlite; and wherein the surface layer of the gradient steel material is ferrite with a carbon content not higher than 0.02 wt %; and the carbon content of the surface layer of the gradient steel material is lower than a carbon content of the inner layer of the gradient steel material.

2. A manufacturing method of a gradient steel material having a surface layer with ferrite and an inner layer with ferrite+pearlite according to claim 1, the manufacturing method including: smelting, casting, rolling and a heat treatment step; wherein in the heat treatment step, the gradient steel material is heated above an austenitizing temperature Ac3, and the austenitizing temperature Ac3 is maintained for at least 3 minutes to ensure that the gradient steel material is completely austenitized; and subsequently the gradient steel material is cooled to a temperature below Ar1 at a cooling rate of less than 0.5° C./s, wherein Ar1 is a temperature at which a transformation from austenite to ferrite is completed during cooling of the gradient steel material.

* * * * *